US006755440B1

(12) United States Patent
Jones

(10) Patent No.: US 6,755,440 B1
(45) Date of Patent: Jun. 29, 2004

(54) SKI POLE

(76) Inventor: Gregory Glenn Jones, 7530 31st Ave., NE., Seattle, WA (US) 98115

( * ) Notice: Subject to any disclaimer, the term of this patent is extended or adjusted under 35 U.S.C. 154(b) by 75 days.

(21) Appl. No.: 10/224,698

(22) Filed: Aug. 21, 2002

Related U.S. Application Data

(62) Division of application No. 09/412,769, filed on Oct. 4, 1999, now Pat. No. 6,460,891.
(60) Provisional application No. 60/104,691, filed on Oct. 17, 1998.

(51) Int. Cl.[7] ..... A63C 11/22; A41D 19/01
(52) U.S. Cl. ..... 280/822; 2/160; 2/161.1
(58) Field of Search ..... 280/822, 819, 280/821; 2/161.1, 158, 159, 160

(56) References Cited

U.S. PATENT DOCUMENTS 3,218,089 A * 11/1965 Marchand ..... 280/822
3,368,811 A * 2/1968 Finney ..... 280/822
4,653,121 A * 3/1987 Kassal et al. ..... 280/822
5,110,154 A * 5/1992 Street ..... 280/822
5,123,674 A * 6/1992 Bagneres et al. ..... 280/822
5,236,223 A * 8/1993 Leon et al. ..... 280/822
5,312,134 A * 5/1994 Goode et al. ..... 280/822
5,328,205 A * 7/1994 Bacharach ..... 280/822
5,516,150 A * 5/1996 Goode et al. ..... 280/822
5,887,282 A * 3/1999 Lenhart ..... 280/822
5,988,681 A * 11/1999 Vesalainen et al. ..... 280/822
6,460,891 B1 * 10/2002 Jones ..... 280/821
6,550,068 B1 * 4/2003 Materon ..... 2/160
6,637,773 B1 * 10/2003 Trinen et al. ..... 280/821

* cited by examiner

*Primary Examiner*—Brian L. Johnson
*Assistant Examiner*—Jeffrey J. Restifo

(57) ABSTRACT

A shock absorbing ski pole with an articulating hand grip that flexes to allow for angular motion between handle and shaft during normal use. The handle contains a spring mechanism that keeps the shaft angled away from the skier when no load is applied. When the skier plants their pole, his forward motion compresses the spring and the shaft flexes into a vertical position, in-line with the grip. The grip also contains a quick release mechanism that allows the ski glove to be quickly and directly attached and unattached to the grip. In addition, the basket of the ski pole is adjustable to allow for different ski conditions. The basket consists of two disks with petals that may be rotated relative to each other. By rotating the disks coincident to each other to reduce wind resistance. However, for soft snow conditions the disks may be rotated such that the petals are offset from each other creating a greater amount of contact with the snow.

4 Claims, 6 Drawing Sheets

SKI POLE

CROSS REFERENCE TO RELATED APPLICATION

This application is a division of application Ser. No. 09/412,769, filed Oct. 4, 1999 now U.S. Pat. No. 6,460,891, which claims the benefit of United States Provisional Patent Application No. 60/104,691, filed Oct. 17, 1998, both of which are hereby incorporated by reference herein in their entirety.

BACKGROUND OF THE INVENTION

The present invention relates to ski poles. More particularly, the present invention relates to ski poles that have a shock absorbing handle, a quick release mechanism, and a variable wind resistance basket. The ski pole is an integral part of skiing. It acts as an extension of the skier's upper body, providing timing, rhythm, balance, support and assists the skier in maintaining proper body position. The ski pole generally consists of a handle rigidly attached to the end of a shaft. In most cases the shaft and handle are arranged in longitudinal alignment with no angular relative motion allowed between the shaft and grip during normal use.

While skiing, the skier desires to reach out with each pole plant to establish the next turn. To do this with a traditional ski pole, the skier must radially flex his wrist to extend the pole to the desired planting position. When the pole is planted, the skier progresses forward while the base of the pole remains stationary and the wrist is flexed back to a neutral position. This repeated action places continual stress on the skier's wrist by forcing him to continually flex his wrist into an unnatural position and apply force to the wrist. This subjects the wrist to forces which may lead to fatigue, soreness and potentially repetitive strain injuries. In addition, traditional ski poles employ straps to assist the skier with holding the ski pole grip and, therefore, potentially distribute the force of a pole plant to the skier's wrist. In this way, traditional ski pole straps may become a mechanism for injury. When the skier falls or the ski pole becomes entangled in brush or other obstructions, the strap stays attached to the skier's hand causing the grip to force the thumb to hyperextend and thereby cause an injury.

In known ski poles, some attempts to provide shock absorption axially along the ski pole can be found. While this may reduce some of the in-line force of a pole plant, it does not address the continual and unnatural flexing and extending of the wrist. To allow the wrist to stay in a neutral, comfortable position while skiing, the ski pole must provide articulation between handle and shaft.

Other attempts have been made to provide an articulating mechanism between ski pole shaft and grip to act as a break-away mechanism. This mechanism is intended to reduce the likelihood-of injury to the skier's hand if excessive force is suddenly applied to the ski pole grip (e.g., during a fall). However, the breakaway mechanism does not reduce the forces applied to the hand and wrist under normal circumstances. The mechanism must be calibrated so that it releases at a predetermined force, which must be more than normal operational forces, but less than enough to cause injury.

Still other attempts have been made to provide a quick release mechanism between ski pole and skier. One theory of operation is to create a break-away strap that releases from the ski pole handle when unusual forces are applied to the strap. Unfortunately this may not allow the ski pole handle to disengage the skier's hand before and injury has occurred. In addition, ski pole straps must be removed before riding a ski lift and reattached after each lift ride. Ski pole straps make this a cumbersome and time-consuming process.

In known ski pole baskets, attempts have been made to provide alternative baskets for differing ski conditions. However, these baskets are not adjustable and require the skier to purchase multiple ski poles. Alternatively, the skier may interchange baskets on one pole, but this is not easily done while skiing to accommodate different ski conditions.

It is therefore an object of the present invention to provide an improved ski pole which allows articulation between the shaft and grip while in use to minimize the deflection and muscular exertion of a skier's wrist and hand.

It is another object of this invention to provide an improved ski pole with a shock absorbing mechanism to reduce the amount of force transmitted to a skier's hand and wrist while in use.

It is still another object of this invention to provide an improved ski pole with a quick release mechanism that assists the skier in retaining the ski pole when in use, but quickly and easily release the pole during a fall or when excessive force is applied to the ski pole.

It is yet another object of this invention to provide an improved ski pole with a mechanism for attaching the ski pole to the skier's glove with a simple, direct connection.

It is a further object of this invention to provide an improved ski pole basket that articulates to accommodate different ski conditions.

SUMMARY OF THE INVENTION

These and other objects of the invention are accomplished in accordance with the principles of the invention by providing a ski pole which is capable of angular articulation between the shaft and grip during normal usage allowing the user to maintain a neutral hand and wrist position. The angle between the grip and shaft may be adjusted such that a neutral, comfortable hand and wrist position for planting the ski pole tip into the snow is achieved. The angular relation between the grip and shaft is maintained through the use of a spring mechanism that holds the shaft forward away from the skier and also acts as a shock absorbing mechanism when loaded during normal use.

The grip contains of a quick release mechanism for directly attaching the grip to a specially design ski glove eliminating the need for ski pole straps for pole retention. This mechanism allows the skier to quickly and easily engage and disengage the ski pole. It also allows the skier to quickly release the pole in the event of a fall, lessening the chances of the pole causing injury to the skier during the fall.

The snow engaging end of the shaft has an adjustable basket designed to prevent the tip of the ski pole from sinking into soft snow past a predetermined depth. The basket may be adjusted for differing snow conditions to provide greater surface area for engaging softer snow or less surface area to reduce wind resistance for use with hard snow conditions.

The ski pole comprises a hollow shaft having a lower pointed tip end for engaging snow and an upper end with an attached grip for engaging a skier's hand. The shaft and grip are connected through a pivot which allows angular motion in the plane of the skier's hand and arm. The shaft is held in a forward position by a spring. The forward limit of travel is maintained by a rigid stop which adjusts to accommodate different forward angles. The tension of the spring may also be adjusted to allow for a greater or lesser amount of shock absorption.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE PREFERRED EMBODIMENTS

Figure 1:
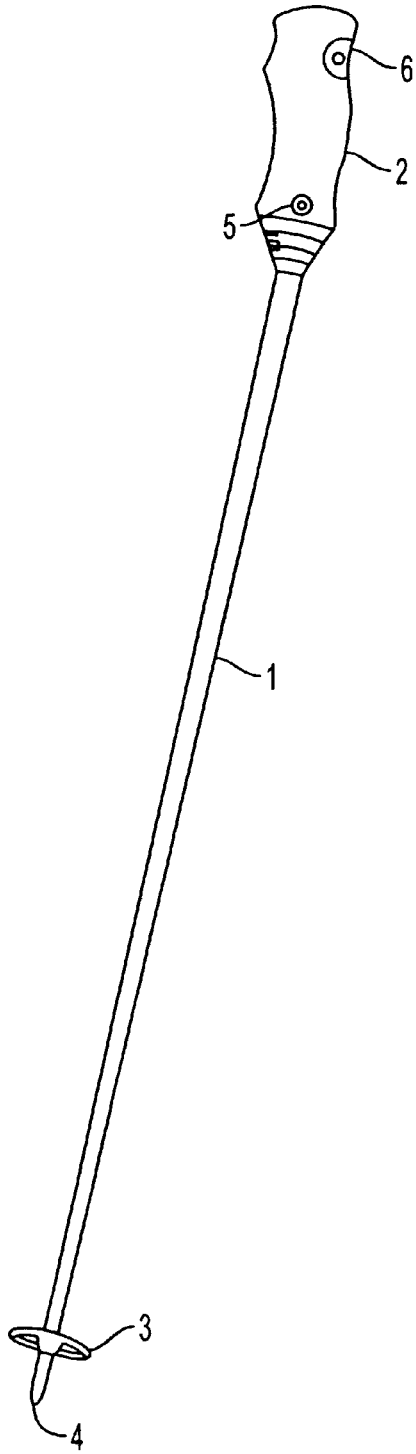
FIG. 1 is an elevational view of a ski pole in accordance with a preferred embodiment of the present invention.

As shown in FIG. 1, a preferred embodiment of the present invention comprises a tubular shaft 1, a handle 2, and a basket 3. As illustrated, handle 2 is located on the top of shaft 1. Adjustable basket 3 is mounted near the bottom of shaft 1. In addition, the bottom of shaft 1 is provided with a tip 4 of conventional design. Basket 3 and tip 4 are preferably designed to engage snow. Preferably, handle 2 is secured to shaft 1 so that it may rotate about the pivot point 5. Preferably, a quick attachment interface 6 is provided in handle 2 that allows a ski glove to directly engage handle 2 at the quick attachment interface 6.

Figure 2:
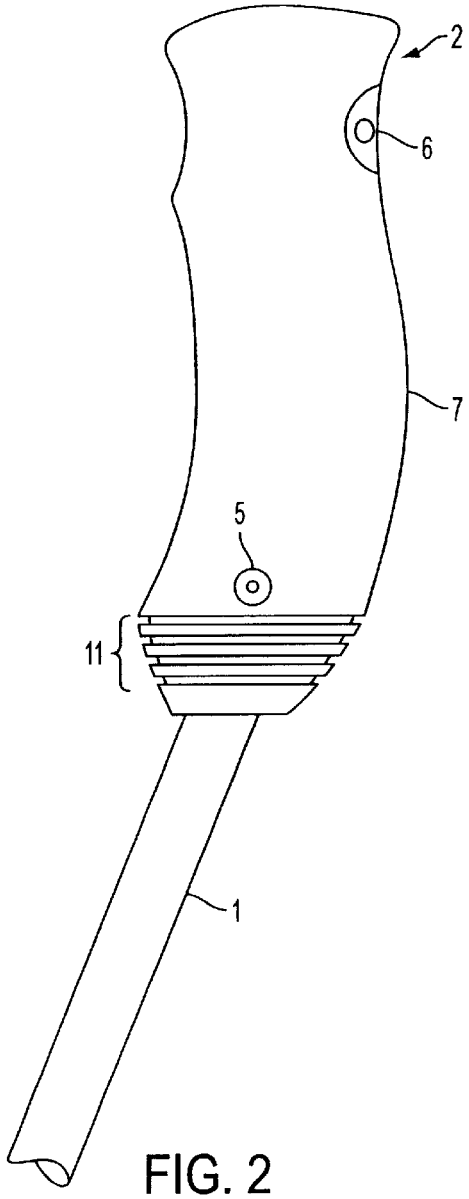
FIG. 2 is an enlarged elevational view of a ski pole grip in accordance with a preferred embodiment of the present invention.
Figure 3:
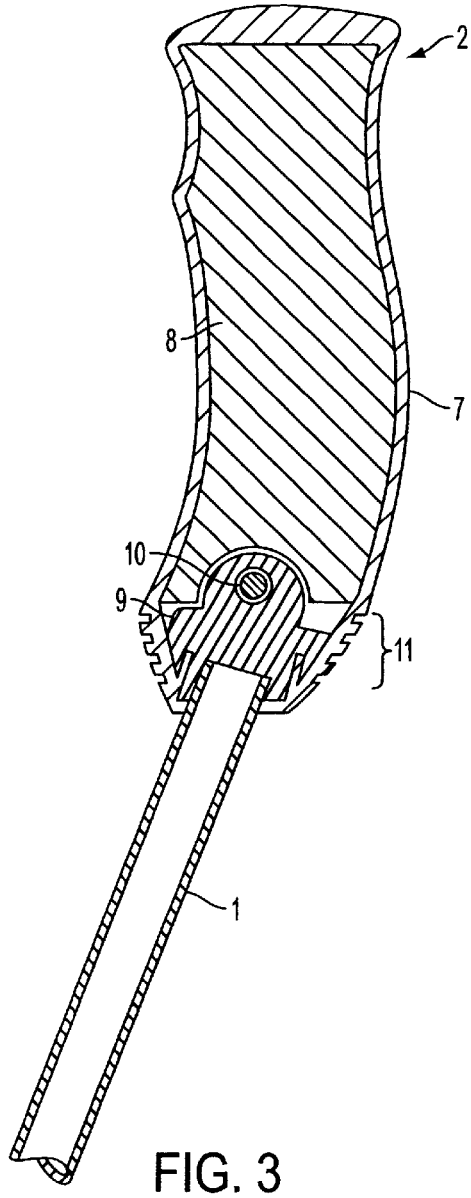
FIG. 3 is an elevational cross-section view of a ski pole grip in accordance with a preferred embodiment of the present invention.
Figure 4:
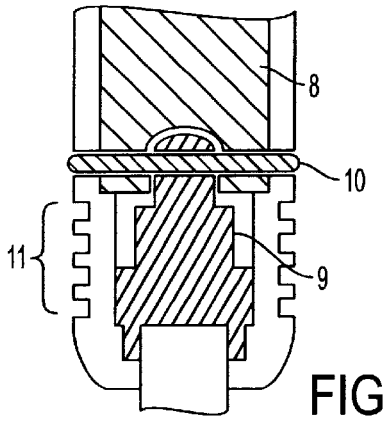
FIG. 4 is another elevational cross-section view of a ski pole grip in accordance with a preferred embodiment of the present invention.

Referring to FIGS. 2–4, preferably handle 2 comprises a softer, flexible outer material 7, preferably rubber, over a harder inner material 8, preferably hard plastic or rubber. An interlocking element 9 engages the shaft 1 and handle 2. This interlocking element is formed preferably of a strong, durable yet lightweight material such as aluminum or plastic. The lower end of interlocking element 9 engages shaft 1 while the upper end attaches to handle 2 using a pin 10 which is pressed or threaded into hard inner material 8. Pin 10 allows interlocking element 9 and shaft 1 to rotate relative to handle 2 about pivot point 5. In this embodiment, the lower portion of the flexible outer handle material 7 may be formed with grooves 11 that allow flexing in this portion of handle 2. The flexible material 7 is formed of flexible resilient spring-like material such as rubber so that it tends to return to its original position after being flexed. In this embodiment, this resiliency and spring-like behavior of material 7 may be used to allow shaft 1 to rotate relative to handle 2 when a skier applies a force during a turn and to return to its original position when the force is removed after the turn has been completed.

FIGS. 5–8 illustrate alternative mechanisms for applying force to return shaft 1 to its original angular relationship relative to handle 2.

Figure 5:
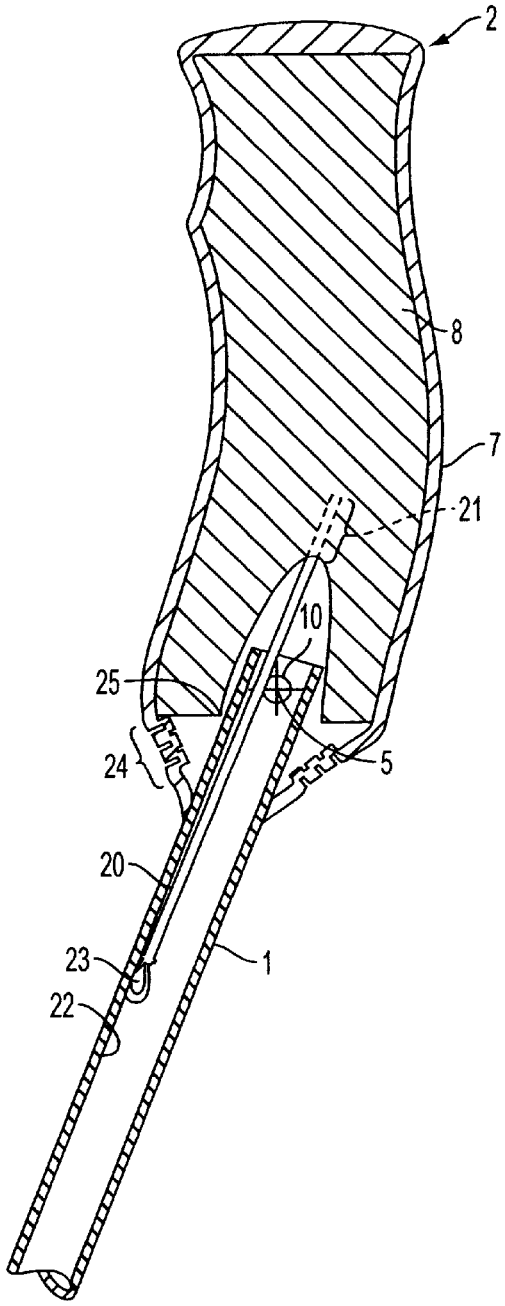
FIGS. 5–8 are various views illustrating alternate methods for providing spring force to return the ski pole its original operating position in accordance with the present invention.

In one alternative embodiment illustrated in FIG. 5, handle 2 and shaft 1 are attached by pin 10 and allowed to rotate relative to each other about pivot point 5. A linear spring 20 is rigidly connected to the inner handle 8 along a length 21 by an insert molding or other process. Shaft 1 is then assembled such that linear spring 20 is inserted into the interior of the shaft 1 between inside shaft wall 22 and attaching pin 10. The lower end of spring 20 has a low friction tip 23 which allows the end of spring 20 to slide easily along the inside of wall 22. A flexible portion 24 of outer handle material 7 encloses the interface of shaft 1 and inner handle 8. During normal use, the pole is planted forcing shaft 1 to rotate relative to handle 2. After the skier lifts the pole from the snow, spring 20 pushes against the inside wall 22 returning shaft 1 until it contacts stop point 25 at its rest position.

Figure 6:
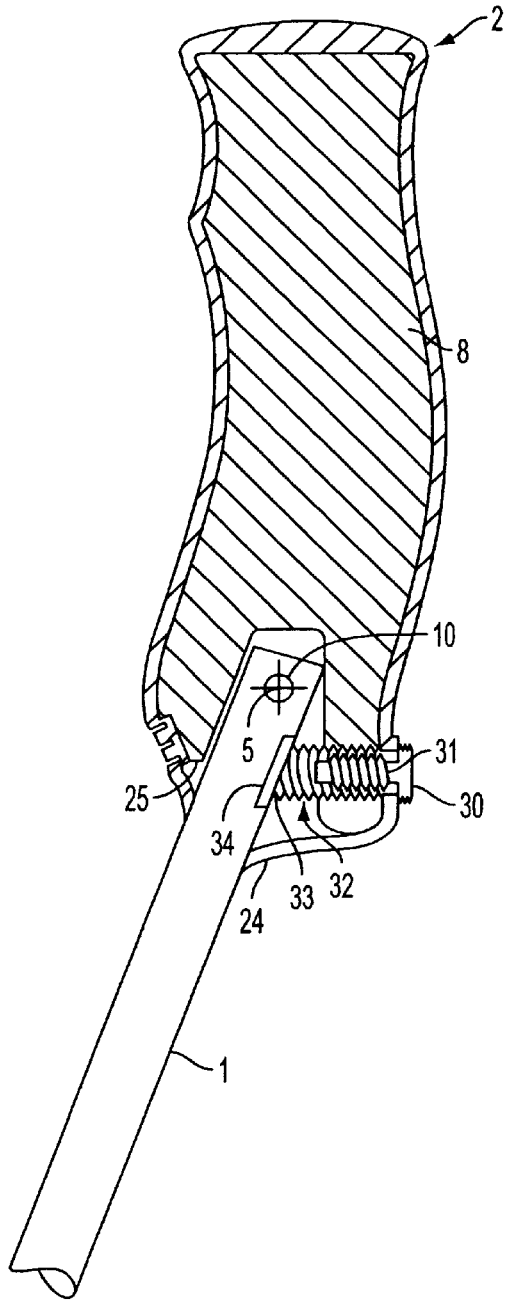

In another alternative embodiment illustrated in FIG. 6, handle 2 and shaft 1 are attached by pin 10 and rotate relative about point 5. An adjusting screw 30 having a threaded shank 31 extends through the wall of the inner handle 8 and engages a compression spring 32. The end of compression spring 32 engages a low friction intermediate component 33 which interfaces the shaft 1 along an interface surface 34. When loaded while in use, the shaft 1 rotates about pivot point 5, compressing spring 32. When unloaded compression spring 32 forces shaft 1 to return to its original position against a stopping surface 25. Adjusting screw 30 allows the force applied by spring 3 to be adjusted.

Figure 7:
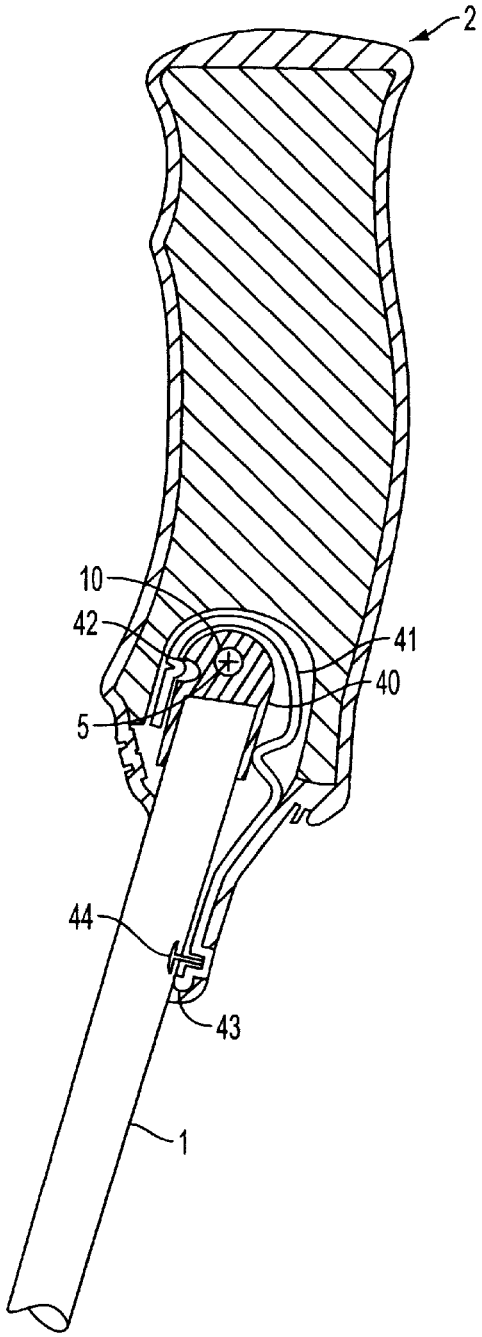

In yet another alternative embodiment illustrated in FIG. 7 a rigid interlocking element 40 is attached to the end of the shaft 1. The interlocking element 40 connects shaft 1 to handle 2 through pin 10. Shaft 1 and interlocking-element 40 are allowed to rotate relative to handle 2 about pivot point 5. Before shaft 1 and interlocking element 40 are attached to handle 2, a leaf spring 41 is placed between interlocking element 40 and handle 2. As shaft 1 and element 40 are inserted into handle 2, leaf spring 41 becomes captured and locks into a notch 42 in interlocking element 40. Lower end 43 of leaf spring 41 attaches to shaft 1 by connector 44. When loaded, the shaft 1 compresses spring 41. When unloaded, spring 41 returns shaft 1 to its original position.

Figure 8:
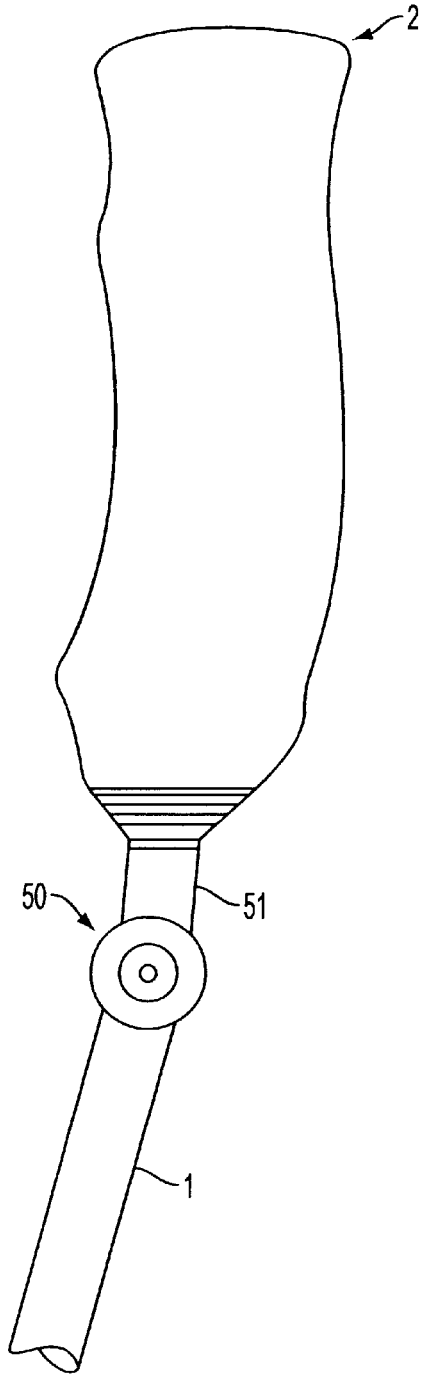

FIG. 8 shows another possible spring configuration where an entire spring mechanism 50 is contained external to handle 2. In this configuration, handle 2 is connected to an upper shaft 51 which connects to an outer spring enclosure 52. Lower shaft 1 is connected to the inner spring enclosure 53 at the top interface 54. Outer spring enclosure 52 and inner spring enclosure 53 are connected by pin 10. Lower shaft 1 and inner spring enclosure 53 pivot about pin 10. Outer spring enclosure 52 and inner spring enclosure 53 are interconnected by coil spring 55 which inserts into attachment points 56. When a load is applied to lower shaft 1, lower shaft 1 rotates relative to upper shaft 51 and winds coil spring 55. When unloaded, coil spring 55 tends to unwind and return lower shaft 1 to its original position.

Figure 9:
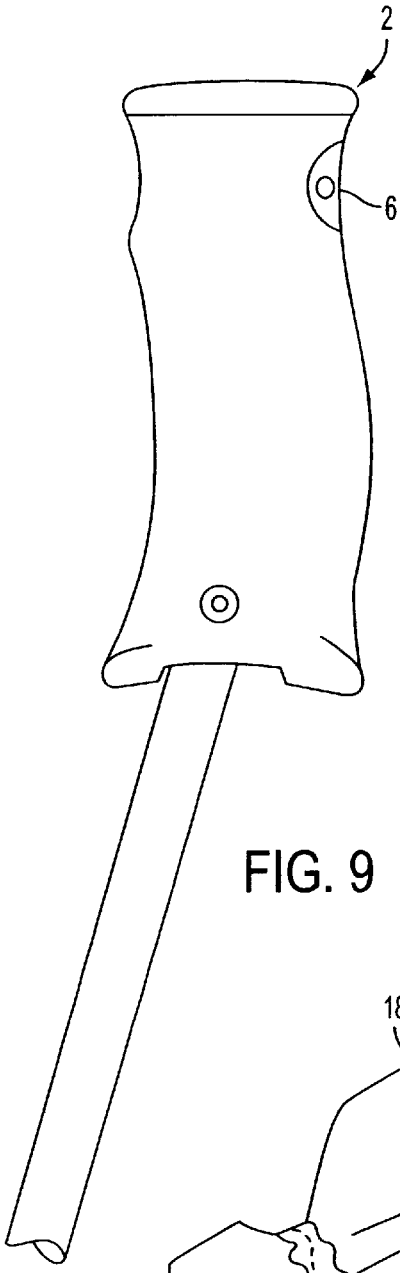
FIG. 9 is an enlarged elevational view of a ski pole grip in accordance with a preferred embodiment of the present invention.
Figure 10:
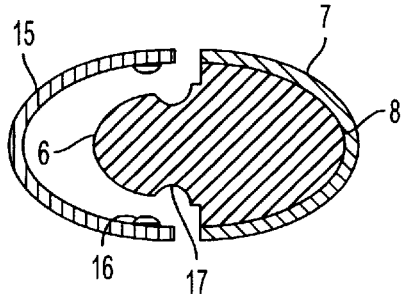
FIG. 10 is a plan cross-section view of a ski pole quick attach/release clip and mating grip attachment interface in accordance with a preferred embodiment of the present invention.
Figure 11:
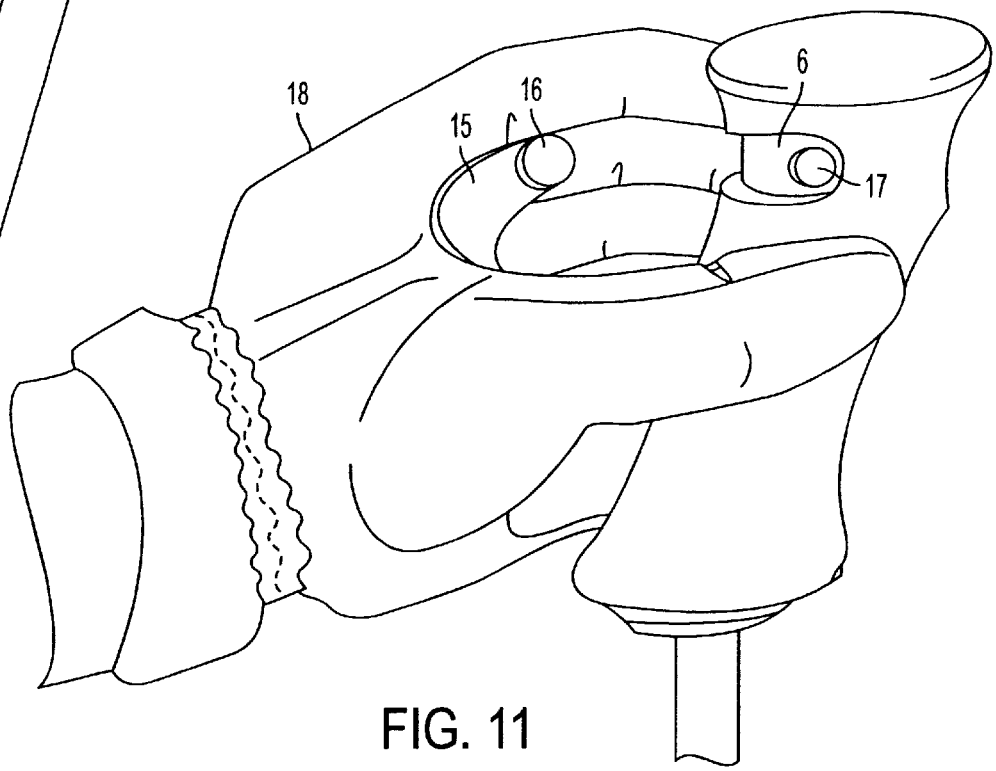
FIG. 11 is a perspective view of a ski pole grip clip in use with the ski pole grip in accordance with a preferred embodiment of the present invention.

In the embodiment of the present invention illustrated in FIGS. 9–11, the ski pole comprises a quick release mechanism. As shown, this mechanism includes a grip clip 15, that may be integrated into a ski glove 18. Grip clip 15 is preferably made of a rigid, flexible material such as plastic or spring steel. Handle 2 is designed with a quick attachment interface 6 which accepts grip clip 15. Outer handle material 7 may be cut away around quick attachment interface 6. Quick attachment interface 6 is preferably part of rigid inner handle 8. During normal operation, clip 15 is flexed open automatically as the skier performs the action of grasping handle 2. When the clip 15 is flexed open, engaging tabs 16 open far enough to reach engaging recesses 17. As long as the skier's hand stays in a normal closed position, tabs 16 remain within recesses 17. When the skier is ready to release ski pole handle 2, such as when the skier falls, the natural action of opening the hand to release the handle flexes clip 15 open allowing tabs 16 to come out of recesses 17.

Figure 12:
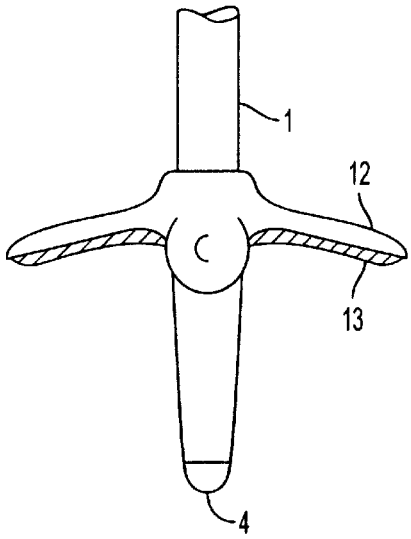
FIG. 12 is an enlarged elevational view of a ski pole basket in accordance with a preferred embodiment of the present invention.
Figure 13:
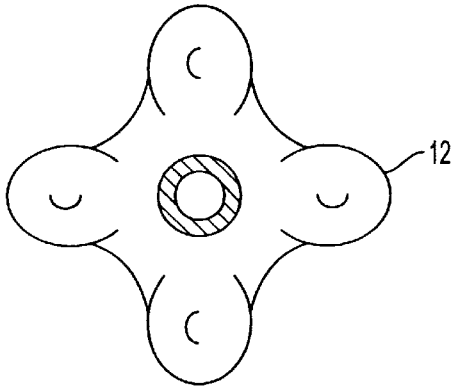
FIG. 13 is a plan view of a ski pole basket in the closed position in accordance with a preferred embodiment of the present invention.
Figure 14:
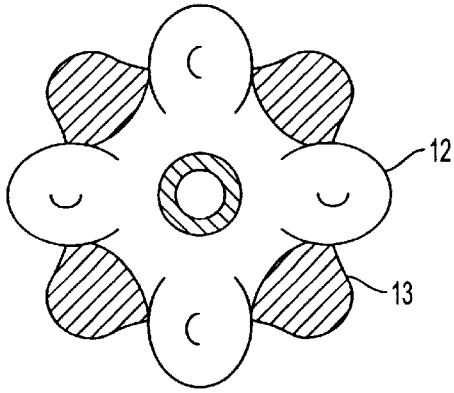
FIG. 14 is a plan view of a ski pole basket in the open position in accordance with a preferred embodiment of the present invention.

FIGS. 12–14 illustrate the snow engaging portion of shaft 1 and adjustable ski pole basket 3. As tip 4 of shaft 1 is pressed into soft snow, the shaft continues to sink into the snow until basket 13 meets the snow. Generally, it is desired for basket 3 to have a minimal amount of surface area to reduce wind resistance. However, during very soft snow conditions, it is desired to have an increased surface area on the snow engaging surface of basket 3. To accommodate these conflicting conditions, the basket 3 in FIGS. 5–7 is created in two parts, an upper basket 12 and a lower basket 13. For conditions where it is desirable to have less surface area, lower basket 13 may be rotated to be aligned with the upper basket as shown in FIG. 6. However, for conditions where more surface area is desired, the lower basket 13 may be rotated to any desired position such as approximately 45 degrees as shown in FIG. 7.

Persons skilled in the art will appreciate that the principles of the present invention can be practiced by other than the described embodiments, which are presented for purposes of illustration and not of limitation, and the present invention is limited only by the claims which follow.

What is claimed is:

1. A ski pole system comprising:

ski pole handle having a substantiallly U-shaped quick attachment interface; and a ski pole glove having a grip clip that is formed from a flexible material, that opens and closes as a wearer opens and closes the space between the wearer's index finger and thumb when in the ski pole glove, that engages the quick attachment interface when the wearer grips the wearer's hand around the ski pole handle when in the ski pole glove, and that releases the quick attachment interface when the wearer ungrips the wearer's hand from the ski pole handle when in the ski pole glove, wherein the quick attachment interface comprises a recess and the grip clip comprises a tab that engages the recess, and wherein said grip clip is substantially U-shaped to fit the shape of a wearer's skin between the wearer's index finger and thumb.

2. The system of claim 1, wherein the quick attachment interface comprises at least two recesses and the grip clip comprises at least two tabs that engage the recesses.

3. The system of claim 1, wherein the grip clip is formed from plastic.

4. The system of claim 1, wherein the grip clip is formed from spring steel.

* * * * *